US005593337A

United States Patent [19]

Lapointe

[11] Patent Number: 5,593,337

[45] Date of Patent: Jan. 14, 1997

[54] FLEXIBLE TOY PIECE SET FOR ASSEMBLY INTO POLYHEDRAL SHAPES

[76] Inventor: Brian Lapointe, 53 Jerdens La., Rockport, Mass. 01966

[21] Appl. No.: 584,781

[22] Filed: Jan. 11, 1996

[51] Int. Cl.[6] ..... A63H 33/08; A63H 33/00

[52] U.S. Cl. ..... 446/125; 446/487

[58] Field of Search ..... 446/125, 124, 446/116, 115, 108, 487, 488, 431, 437, 122, 120; 52/DIG. 10

[56] References Cited

U.S. PATENT DOCUMENTS

| | | | |
|---|---|---|---|
| 3,562,077 | 2/1971 | Raba | 446/125 X |
| 3,564,758 | 2/1971 | Willis | 446/116 X |
| 3,701,214 | 10/1972 | Sakamoto | 446/116 X |
| 4,055,690 | 10/1977 | Patterson | 446/488 X |

FOREIGN PATENT DOCUMENTS

| | | | |
|---|---|---|---|
| 2804797 | 8/1979 | Germany | 446/115 |

*Primary Examiner*—Robert A. Hafer
*Assistant Examiner*—D. Neal Muir
*Attorney, Agent, or Firm*—Brian M. Dingman

[57] ABSTRACT

A toy set that can be assembled into roughly polyhedral shapes, the toy set including a number of toy pieces each made from a relatively thin, flexible material, each having a defined edge shape, and each including at least three non-radial slots communicating with the edge and sized and shaped to hold another toy piece inserted in the slot, to allow the toy pieces to be interfitted and assembled into roughly polyhedral shapes.

33 Claims, 6 Drawing Sheets

FLEXIBLE TOY PIECE SET FOR ASSEMBLY INTO POLYHEDRAL SHAPES

FIELD OF INVENTION

This invention relates to a toy set made of relatively thin, flexible shapes that can be assembled into polyhedra.

BACKGROUND OF INVENTION

Toys should be fun to play with and look at, and stimulate creativity. Many toys achieve some but not all of those objectives. There are toy sets designed for small children that include a number of hard disks with radial slots that allow the pieces to be interfitted. Because the slots are radial and the pieces have limited flexibility, however, the shapes that can be made with such toy sets are linear and thus of limited interest.

There are also educational sets on the market that include hard plastic polygonal shapes that snap together along their edges to form polyhedra. Such sets are educational but do not have the play value and appearance of a toy product. Further, they require a relatively complex edge interfitting design.

SUMMARY OF THE INVENTION

It is therefore an object of this invention to provide a toy set that is fun, interesting to play with, appealing to look at, and educational.

It is a further object of this invention to provide such a toy set including a number of toy pieces that can be assembled into a variety of roughly polyhedral shapes but with an interesting appearance.

It is a further object of this invention to provide such a toy set that can be assembled into shapes that resemble balls so that they can be played with like balls.

This invention features in one embodiment a toy set that can be assembled into roughly polyhedral shapes, the toy set including a number of toy pieces each made from a relatively thin, flexible material, each having a defined edge shape, and each including at least three non-radial slots communicating with the edge and sized and shaped to hold another toy piece inserted in the slot, to allow the toy pieces to be interfitted and assembled into roughly polyhedral shapes.

The slots are preferably symmetric about the center of the pieces. The pieces preferably include retaining means for holding together interfitted pieces to provide strength to assembled polyhedral shapes. The retaining means may include one or more tabs projecting into the slots. Preferably, there is a tab along the edge of the piece projecting into each slot. The pieces may be shaped and the slots made sufficiently long enough so that when two pieces are interfitted slot-to-slot, the retaining tab from one piece fits within another slot of the other piece and against the retaining tab therein to prevent the pieces from sliding apart. The retaining means may alternatively or additionally include a slot width essentially equal to the piece material thickness to grip and hold interfitting pieces. Because the material is flexible, it can be bent to allow the pieces to be interfitted into roughly polyhedral shapes.

The slots may be roughly straight or not. The slots may alternatively be curvilinear. Preferably, the slots roughly lie along lines defining the sides of a polygon to define roughly polygonal shapes from which the polyhedra are formed. With straight slots, the slots can lie directly along such lines.

With other shaped slots, such as jagged or curvilinear slots, the slots may lie more roughly along such lines to define a roughly polygonal shape, for example a roughly triangular shape with curved sides. The formed polygon may be a triangle, a square or another tetragon, a pentagon, a hexagon, or any other regular or non-regular polygon. In the preferred embodiment, the slots in each piece are identical and lie along lines defining the sides of a regular polygon.

The pieces may be made from any material having sufficient strength and flexibility, including plastic foam material. The pieces can be stamped out of extruded plastic foam sheets. In order to provide multi-colored pieces, the material may be different colored laminated plastic foam sheets. The pieces may include one or more removable punch-outs which may be formed at the same time the pieces are stamped from the foamed plastic sheets. A punch out may be located interiorly of the slots so that it can be pushed into the interior of a polyhedron assembled from the toy pieces.

The defined edge shape of the pieces defines the form or overall shape of the polyhedra formed of the pieces. The defined edge shape also affects the function of the polyhedra as well as their strength. It establishes the gripability and aerodynamics of the assembled pieces when used as a ball, as well as how it rolls. The look, feel and ease of construction are also dictated at least to some extent by the defined edge shape. Any defined edge shape is contemplated herein, including roughly circular, roughly polygonal, roughly hexagonal, roughly pentagonal, roughly star shaped, a roughly curved shape, including shapes that may or may not be circumscribed by a circle.

This invention also features a toy set that can be assembled into roughly polyhedral shapes, the toy set including a number of toy pieces each made from a relatively thin, flexible foamed plastic material, each having a defined edge shape, and each including three slots symmetrically arranged around the center of the piece and lying roughly along lines defining the sides of an equilateral triangle to define a roughly triangular polyhedron face, each slot communicating with the edge of the piece and about as wide as the thickness of the material, to hold another toy piece inserted in a slot, to allow the toy pieces to be interfitted and assembled into polyhedra including roughly triangular faces.

The toy set may also include toy pieces made from the same material and including more than three slots symmetrically arranged around the center of the piece and lying roughly along lines defining the sides of a regular polygon to define roughly polygonal polyhedron faces, each slot communicating with the edge of the piece and about as wide as the thickness of the material, to hold another toy piece inserted in a slot, to allow the toy pieces to be interfitted and assembled into polyhedra including roughly triangular and other roughly regular polygonal faces.

The toy set pieces may include tabs projecting into the slots for holding together interfitted pieces to provide strength to the assembled polyhedral shapes.

This invention also features a toy set that can be assembled into roughly polyhedral shapes, the toy set including a number of toy pieces each made from a relatively thin, flexible foamed plastic material, each having a defined roughly circular edge shape, and each including three straight slots symmetrically arranged around the center of the piece and lying roughly along lines defining the sides of an equilateral triangle to define a roughly triangular polyhedron face, each slot communicating with the edge of the piece and about as wide as the thickness of the material, to hold another toy piece inserted in a slot, to allow the toy pieces to be interfitted and assembled into polyhedra including roughly triangular faces.

In another embodiment, this invention features a toy set assembled into a roughly tetrahedral shape, the toy set including four toy pieces each made from a relatively thin, flexible foamed plastic material, each having a defined edge shape, and each including three slots symmetrically arranged around the center of the piece and lying roughly along lines defining the sides of an equilateral triangle to define a roughly triangular tetrahedron face, each slot communicating with the edge of the piece and about as wide as the thickness of the material, each slot holding another toy piece inserted therein, to hold together the toy pieces into a roughly tetrahedral shape including four roughly triangular faces.

Still another embodiment features a toy set assembled into a six-sided roughly polyhedral shape, the toy set including six toy pieces each made from a relatively thin, flexible foamed plastic material, each having a defined edge shape, and each including three slots symmetrically arranged around the center of the piece and lying roughly along lines defining the sides of an equilateral triangle to define a roughly triangular polyhedron face, each slot communicating with the edge of the piece and about as wide as the thickness of the material, each slot holding another toy piece inserted therein, to hold together the toy pieces into a triangular bipyramid including six roughly triangular faces.

Yet another embodiment features a toy set assembled into a roughly octahedral shape, the toy set including eight toy pieces each made from a relatively thin, flexible foamed plastic material, each having a defined edge shape, and each including three slots symmetrically arranged around the center of the piece and lying roughly along lines defining the sides of an equilateral triangle to define a roughly triangular octahedron face, each slot communicating with the edge of the piece and about as wide as the thickness of the material, each slot holding another toy piece inserted therein, to hold together the toy pieces into a roughly octahedral shape including eight roughly triangular faces.

In yet another embodiment this invention features a toy set assembled into a roughly platonic solid polyhedral shape, the toy set including a number of toy pieces each made from a relatively thin, flexible foamed plastic material, each having a defined edge shape, and each including three, four or five slots symmetrically arranged around the center of the piece and lying roughly along lines defining the sides of an equilateral triangle, a square and a pentagon, respectively, to define a platonic solid face, each slot communicating with the edge of the piece and about as wide as the thickness of the material, to hold another toy piece inserted therein, to hold together the toy pieces into a platonic solid shape including roughly triangular, square or pentagonal faces. These platonic shapes include, in addition to polyhedra already mentioned, the icosahedron (made with twenty triangles), the cube (made with six squares), and the dodecahedron (made with twelve pentagons).

BRIEF DESCRIPTION OF THE DRAWINGS

Other objects, features and advantages will occur to those skilled in the art from the following description of preferred embodiments and the accompanying drawings, in which.

DESCRIPTION OF THE PREFERRED EMBODIMENTS

This invention may be accomplished in a toy set that can be assembled into roughly polyhedral shapes. The toy set includes a number of toy pieces (a minimum of four), each made from a relatively thin, flexible material such as a foamed plastic material. Each piece has a defined edge shape such as the roughly circular shape of piece 10, FIG. 1A. Each piece includes at least three non-radial slots communicating with the edge and sized and shaped to hold another toy piece inserted in the slot. This arrangement allows the toy pieces to be interfitted and assembled into roughly polyhedral shapes.

Figure 1A:
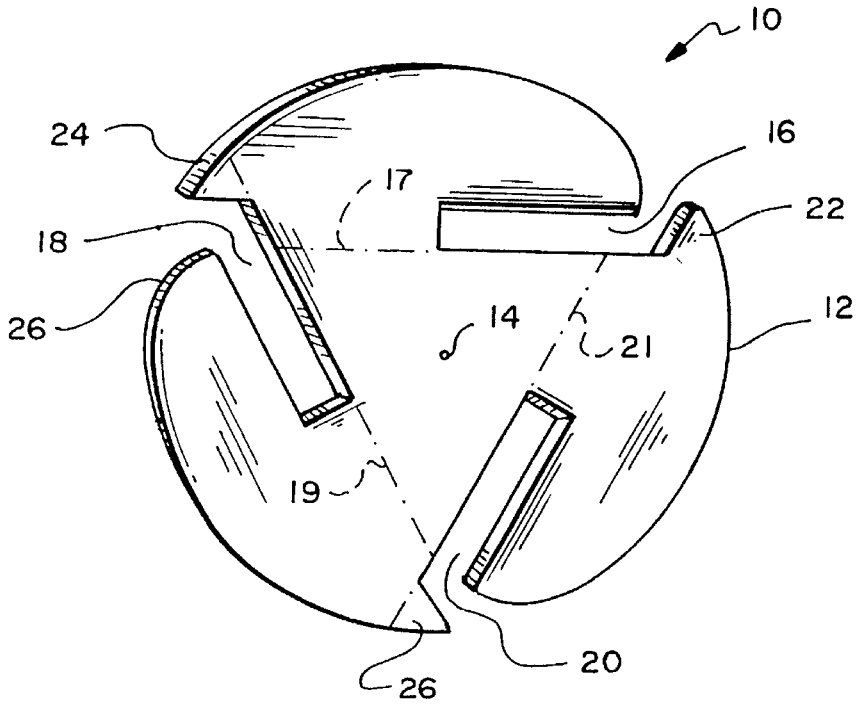
FIG. 1A is a three dimensional view of a flexible toy piece of this invention.

The toy pieces are designed to be interfitted slot-to-slot to allow the assembly of a multitude of polyhedra. The slots are preferably symmetric about the center of the pieces, and lie roughly along lines defining the sides of a polygon to define a roughly polygonal panel shape from which the polyhedra are formed. An example is shown in FIG. 1A, in which slots 16, 18 and 20 lie along lines 17, 19 and 21, respectively, defining the three sides of an equilateral triangle. Thus, the three slots are symmetrically arranged about center 14 of piece 10, which has defined edge shape 12 roughly defining a circle.

The pieces preferably include retaining means such as tabs 22, 24 and 26 for holding together interfitted pieces to provide strength to the assembled roughly polyhedral shapes. These tabs project into the slots along the edges of the pieces. Alternative arrangements of the tabs are contemplated, for example having one or more tabs along the length of the slots. Other retaining means are also contemplated such as, for example, providing a slot width which is essentially equal to the piece material thickness so that the pieces grip and hold one another. In the case in which the pieces are made from a foamed plastic material, the material surfaces are somewhat irregular which accomplishes a better frictional fit with the proper slot width. In the preferred embodiment, the retaining means is accomplished with both tabs and the slot width and material flexibility and surface characteristics, all of which contribute to the interlocking of the pieces that helps to maintain the interfitted pieces in the assembled roughly polyhedral shape.

Figure 1B:
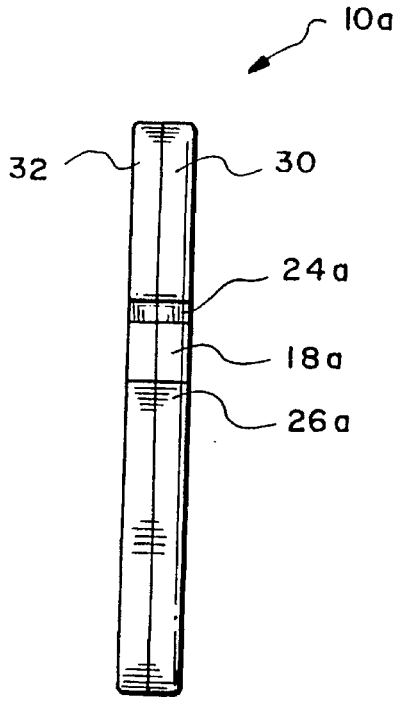
FIG. 1B is a side view of one form of the toy piece of FIG. 1A.

The material from which the pieces are made needs to be flexible so that the pieces can be bent sufficiently to allow the slot-to-slot assembly. Materials such as foamed plastic, rubbers, vinyl, cardboard, and other flexible materials may be used. The current preferred material is a six pound per cubic foot F-cell polyethylene foam, which is a closed-cell, cross-linked foam having excellent strength and durability. The pieces are made by die cutting them out of an extruded plastic foam panel. To accomplish multi-colored pieces, different colored sheets can be flame laminated together before they are die cut. An example of this is shown in FIG. 1B, in which piece 10*a* is comprised of laminated layers 30 and 32 which are each foamed plastic layers that are laminated together before the pieces are cut from the sheets. Also shown in this side view are cut out portion 26 and tab 24. Portion 26 allows the pieces to be interfitted more easily and also removes some material that otherwise would interfere with an interfitting piece.

Tab 24*a*, as explained above, is the major contributor to the retaining means that interlocks the pieces so that the assembled roughly polyhedral shapes stay together. This allows the assembled shapes to be used like a ball; they can be rolled or thrown. The different polyhedra that can be formed, and the different overall shape accomplished by the particular edge shapes of the pieces interfitted together, provide an interesting and pleasing external appearance, as well as the functions of grippability, aerodynamics, and how the piece rolls when played with.

Figure 2A:
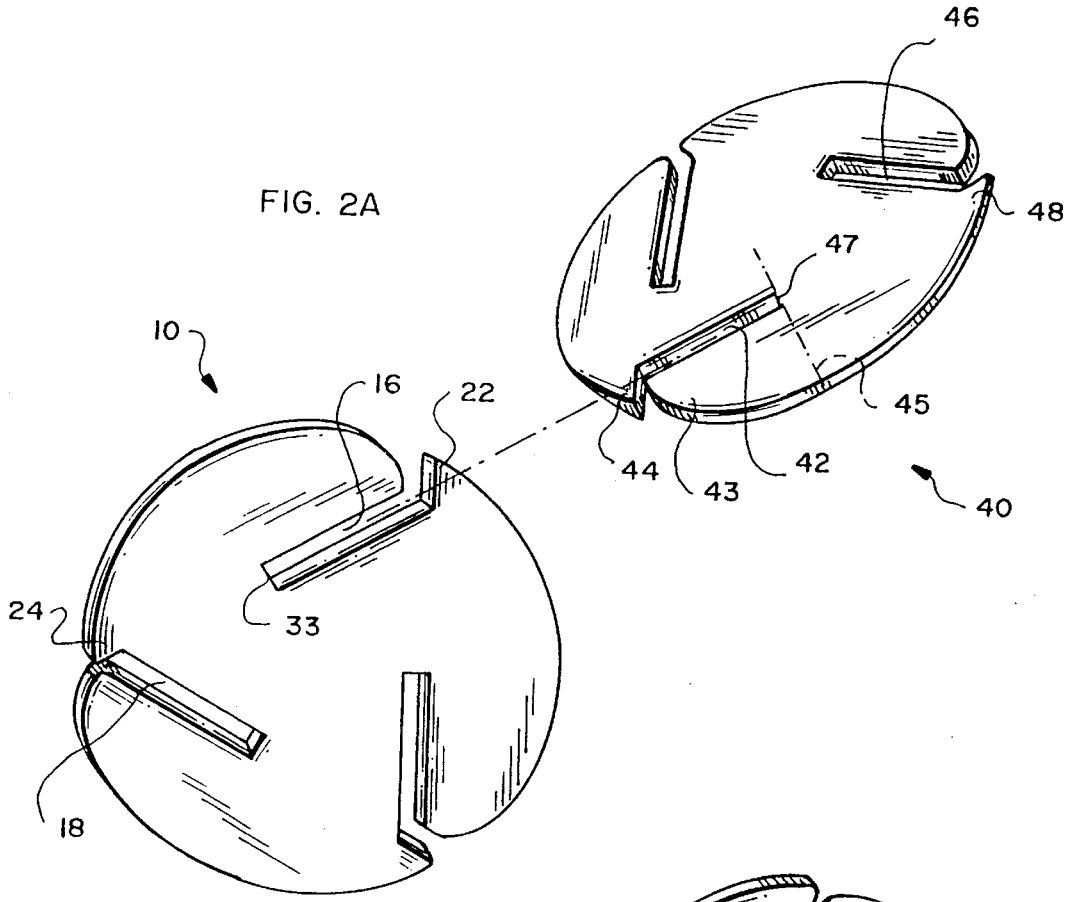
FIGS. 2A and 2B detail the manner in which two of the toy pieces of FIG. 1A are interfitted in order to assemble a roughly polyhedral shape from a number of the toy pieces.
Figure 2B:
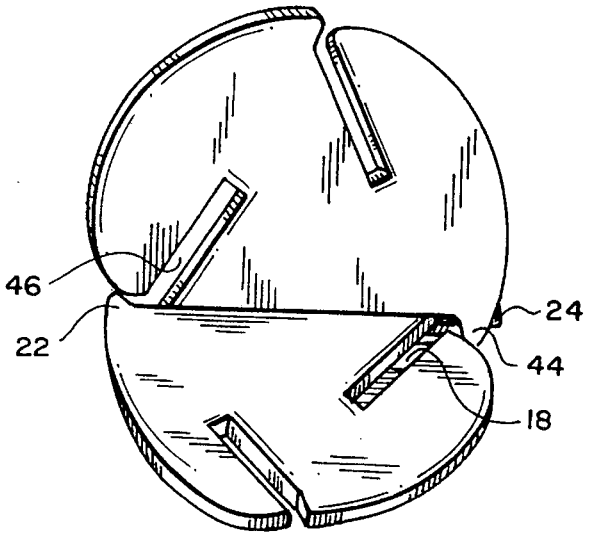

FIGS. 2A and 2B illustrate the interfitting of two identical toy pieces of the type show in FIG. 1A. When assembled with slot 16 intersecting slot 42, tab 44 sits in slot 18 adjacent to tab 24, and tab 22 sits in slot 46 adjacent to tab 48. This prevents the pieces from disengaging by sliding along their respective slots. Engagement can be accomplished, for example, by folding portion 43 up along fold line 45 and inserting piece 40 into slot 16 of piece 10, and then allowing portion 43 to return to its original position. End 47 of slot 42 touches end 33 of slot 16.

Using the shapes detailed in FIG. 1A, a number of polyhedra can be formed. For example, any polyhedron that can be formed from triangular faces can be made. This includes the tetrahedron 100 of FIG. 3, the six sided triangular bipyramid 200, FIG. 4, and octahedron 300, FIG. 5. Ten, twelve, sixteen and twenty-sided polyhedra can also be formed with the triangular panel shape of FIG. 1. Other constructions may also be possible.

Figure 3:
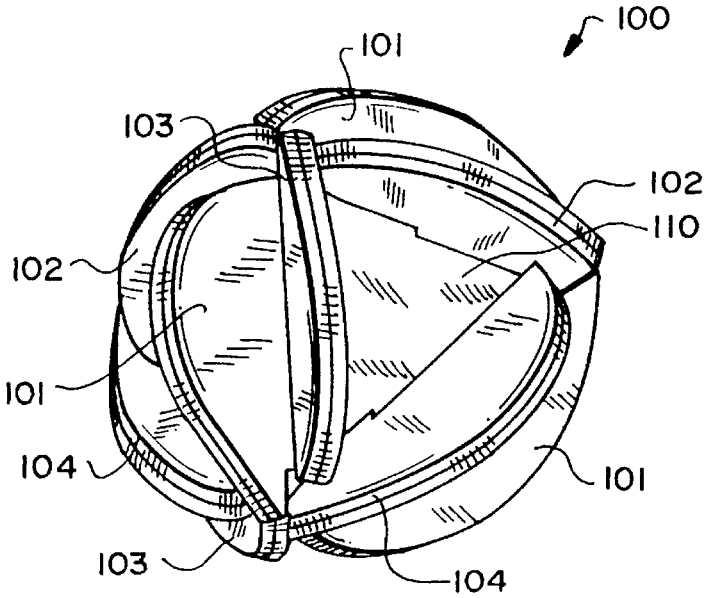
FIG. 3 is a view of a roughly tetrahedral shape made from four of the pieces shown in FIG. 1A.

The most simple polyhedron that can be formed from a triangular panel face is the tetrahedron 100, FIG. 3. This is formed of four identical pieces 101 through 104 interfitted as shown in the drawings. One roughly triangular panel 110 formed by toy piece 101 is shown in the figure.

Figure 4A:
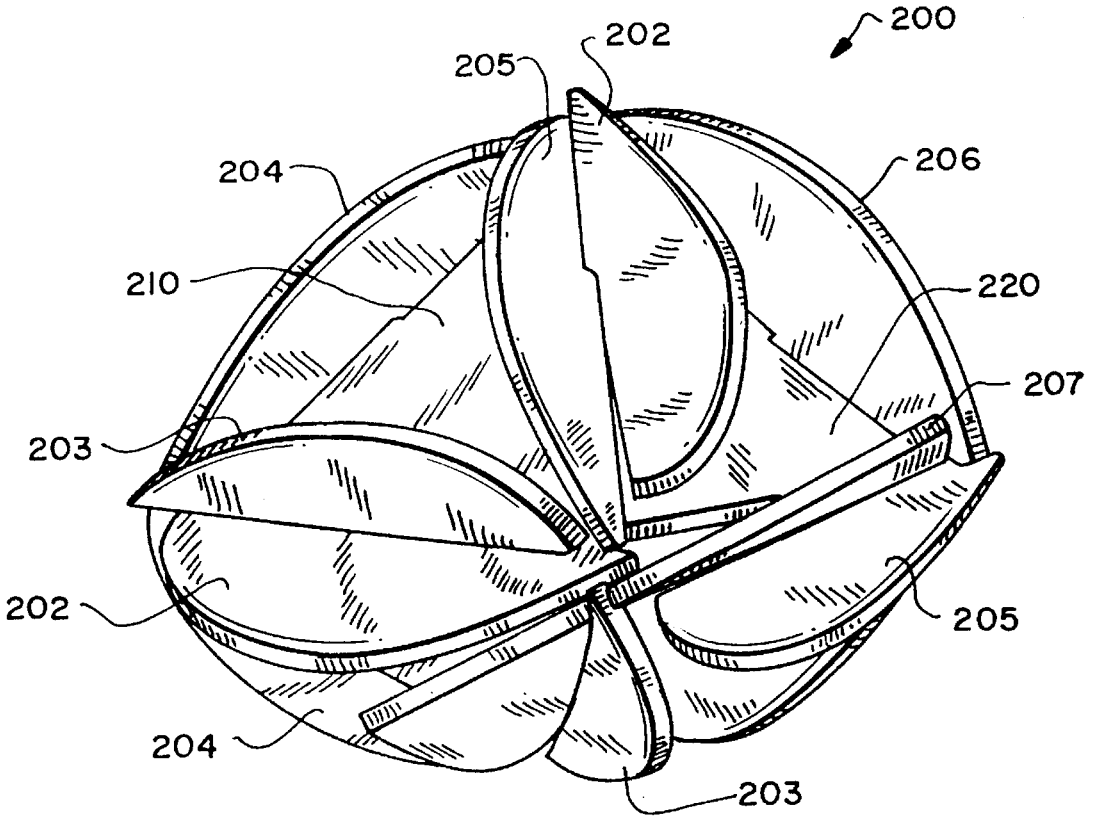
FIG. 4A is a view of a six sided roughly triangular bipyramid polyhedral shape made with six of the pieces of FIG. 1A.
Figure 4B:
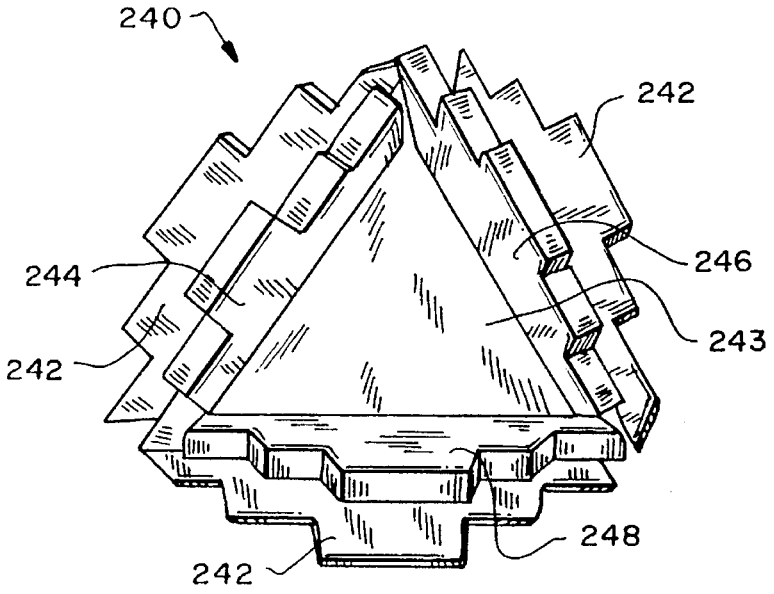
FIG. 4B is a view of a triangular bipyramid made with six of the pieces of FIG. 7.

FIG. 4A details a six-sided, bilateral pyramid made with six of the shapes of FIG. 1A. FIG. 4B is a view of the same polyhedron made with six of the pieces detailed in FIG. 7—illustrating the different look and feel created by a different edge shape for the pieces of this invention.

Shape 200, FIG. 4A, includes interfitted pieces 202 through 207. Roughly triangular panel faces 210 of piece 202, and 220 of piece 205, are visible in this view. In the view of FIG. 4B, in which pieces 242, 244, 246, and 248 are interfitted, only triangular face 243 of piece 242 is shown.

Figure 5:
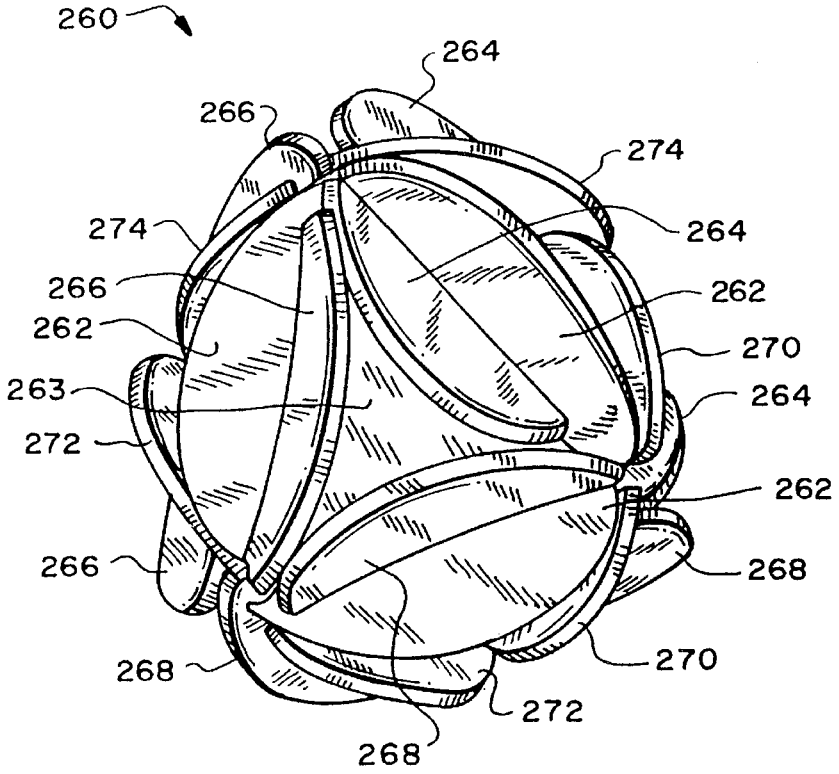
FIG. 5 is a view of a roughly octahedral shape made from eight of the pieces of FIG. 1A.

Octahedron 260, FIG. 5, is formed by interfitting eight of the pieces shown in FIG. 1A. Piece 262 has fitted into it pieces 264, 266, and 268. The other end of octahedron 260 (not shown) would also consist of a piece, not visible at all in the drawing, in which was fitted pieces 270, 272, and 274.

For the case in which the slots in the pieces lie along lines defining the sides of a polygon, particularly a regular polygon, the polyhedra that can be formed are known in the field of geometry. It is not a limitation of this invention that all of the pieces that are assembled into a polyhedron have the same number of slots, or the same polygon panel shape defined by the lines along which the slots roughly lie. For example, a snub cube is a polyhedron formed from squares and triangles. This shape can be assembled with the correct number of three slotted and four slotted pieces, in which the slots lie roughly along lines defining triangles and squares, respectively. Another example is the truncated cuboctahedron which is formed from squares, hexagons, and octagons.

The polyhedra that can be formed are thus virtually unlimited. For example, all five of the platonic solids can be made with slots defining triangles, squares, and pentagons. These solids can be decorated in manners known in the field of geometry.

In describing the construction of the pieces and the assembled polyhedra according to this invention, the term "roughly" is used to indicate that the polygons and the polyhedra may not be exact. FIG. 1A details three slots which lie along lines defining an equilateral triangle. The slots, however, could be less radial so that the vertices of the triangle did not fall within the shape itself. Or, the slots can be other than straight-shapes such as the curvilinear-shaped slots shown in FIG. 11 and described below. Because the material from which the pieces are made is flexible, however, even such curvilinear slots can be used to form polyhedra—the pieces can bend and the slots can flex and meet only partially along their lengths in order to allow the assembly of polyhedra.

Also because of the slotting, and the material flexibility and compressibility, when the pieces are assembled some portions of the pieces may be bent or flexed or compressed so that the faces of the polyhedra may not be exactly polygonal. Rather, they may be roughly polygonal.

Figure 6:
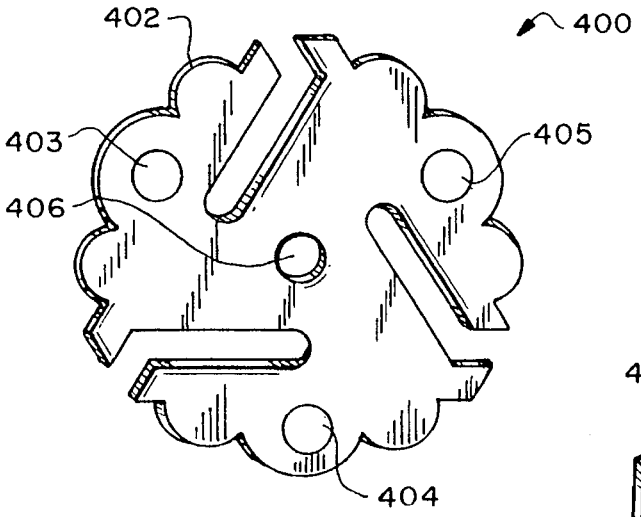
FIGS. 6 through 8 detail three of the innumerable defined edge shapes that can be accomplished for the toy piece of this invention.

FIGS. 6 though 9 detail three more of the virtually unlimited possible edge shapes of the toy pieces of this invention. Each of these edge shapes exhibits trilateral symmetry, as do the slots. This is not a necessary limitation of the invention, however, as the edge shape need not be synunetric, and need not have the same symmetry as the slots, if indeed the slots do have symmetry. Piece 400, FIG. 6, has roughly curvilinear lobes along each of the three sides between the three slots defined by edge shape 402. Also illustrated in this figure is the inclusion of four removable punch-outs. Punch-outs 403 through 405 are illustrated still within toy piece 400, whereas the punch-out which sits in hole 406 has been removed. Locating a punch-out such as punch-out 406 interiorly of the three slots allows the punch-out to be pushed into the inside of an assembled polyhedron so that the punch-out can rattle around the interior of the polyhedron to provide aural stimulation when the shapes are played with.

Figure 8:
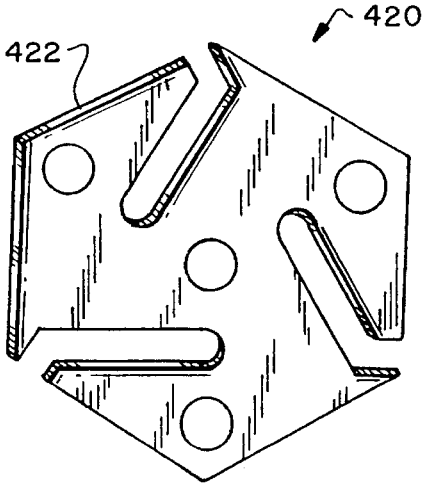
Figure 7:
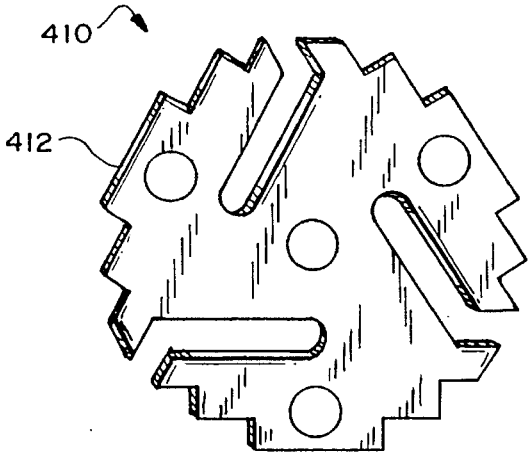

Toy piece 410, FIG. 7, has edge shape 412 that is similar to edge shape 402 of piece 400, FIG. 6, except the edges are formed of straight lines, rather than being curvilinear. Edge shapes 402 and 412 also illustrate edge shapes that may be circumscribed by a circle, another preferred form of the edge shape of this invention. FIG. 8 illustrates yet another edge shape which is similar to a three-sided star—the edge lobes outside of the slots are trilateral triangles.

Figure 9:
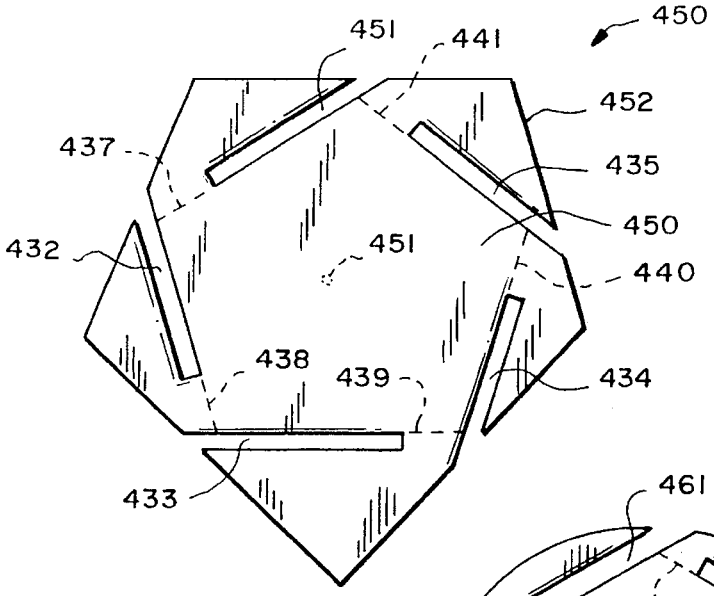
FIG. 9 is a top view of a pentagonal toy piece with five straight slots symmetrically arranged about the center of the piece along lines defining a pentagon.
Figure 10:
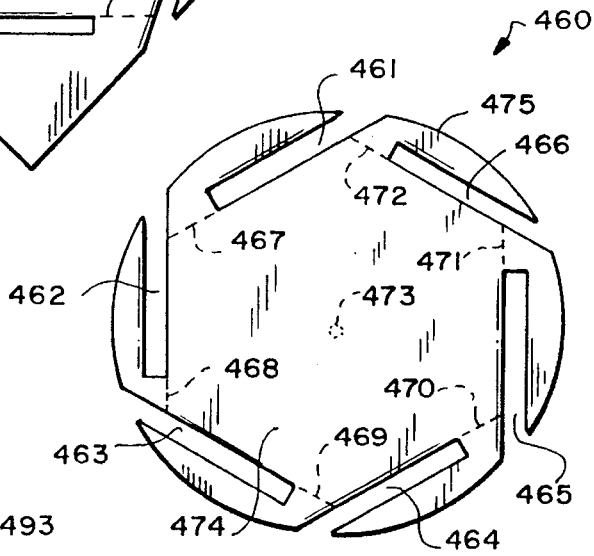
FIG. 10 is a top view of a six-slot piece.
Figure 11:
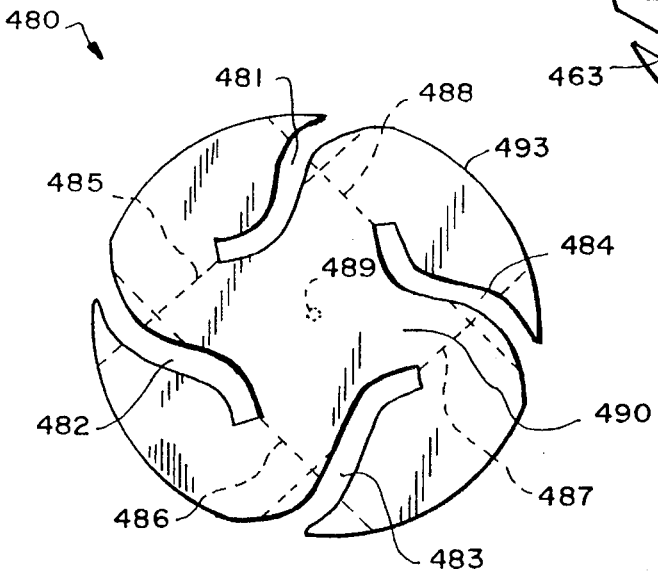
FIG. 11 is a top view of a four slot piece illustrating the concept of curvilinear slots lying roughly along the lines defining the sides of the square to define a roughly square polyhedron face.

FIGS. 9 through 11 illustrate possibilities for different arrangements of slots. FIGS. 9 and 10 illustrate slots lying along lines forming a pentagon and hexagon, respectively. FIG. 11 illustrates curvilinear slots lying roughly along lines defining a square.

Toy piece 430, FIG. 9, has five slots 431 through 435 that lie directly along lines 437 through 441 that define a pentagon. Edge shape 452 is accomplished to provide symmetric triangular tabs exteriorly of the slots. The slots and the external shape are each symmetric about center 451.

Toy piece 460, FIG. 10, is similar in that the six slots 461 through 466 lie along lines 467 through 472 that define a hexagon. The slots and the external tabs formed by the edge shape 475 are both symmetric about center 473. The slots roughly define hexagon 474 that becomes the roughly polygonal shape that forms a face of a roughly polyhedral shape that is made by assembling a number of toy pieces.

FIG. 11 details curvilinear slots 481 through 484 that lie roughly along lines 485 through 488 that define roughly square panel 490 which would become one face of a roughly polyhedral shape. The roughly circular edge shape 493 in conjunction with the symmetrically arranged slots provides symmetry to both the slots and the external tab portions about center 489.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A toy set that can be assembled into roughly polyhedral shapes, the toy set including a number of toy pieces each made from a relatively thin, flexible material, each having an external edge with a defined edge shape, and each including at least three elongated, non-radial slots communicating with the edge and sized and shaped to hold another toy piece inserted on edge in the slot, slot-to-slot, to allow the toy pieces to be interfitted and assembled into roughly polyhedral shapes; in which there is a single tab projecting into each slot at the edge of the piece, interrupting and changing the course of the slot, to firmly hold together the interfitted toy pieces.

2. The toy set of claim 1 in which the toy pieces have centers, and the slots are symmetric about the center of the pieces.

3. The toy set of claim 1 in which the pieces include retaining means for holding together interfitted pieces to provide strength to assembled roughly polyhedral shapes.

4. The toy set of claim 3 in which said retaining means includes tabs projecting into the slots.

5. The toy set of claim 3 in which said retaining means includes a slot width essentially equal to the piece material thickness to grip and hold interfitting pieces.

6. The toy set of claim 1 in which the slots are roughly straight.

7. The toy set of claim 1 in which the slots roughly lie along lines defining the sides of a polygon to define a roughly polygonal shape from which the polyhedra are formed.

8. The toy set of claim 7 in which the polygon is a triangle.

9. The toy set of claim 7 in which the polygon is a square.

10. The toy set of claim 7 in which the polygon is a pentagon.

11. The toy set of claim 7 in which the polygon is a hexagon.

12. The toy set of claim 7 in which the polygon is a tetragon.

13. The toy set of claim 7 in which the slots are roughly straight.

14. The toy set of claim 1 in which all of the slots in any given piece are identical.

15. The toy set of claim 1 in which at least some of the slots are curvilinear.

16. The toy set of claim 1 in which the material is plastic foam sheets.

17. The toy set of claim 16 in which the material is laminated plastic foam sheets.

18. The toy set of claim 1 in which the toy pieces further include at least one removable punch-out.

19. The toy set of claim 18 in which a punch-out is located interiorly of the slots so that it can be pushed into the interior of a polyhedron assembled from the toy pieces.

20. The toy set of claim 1 in which the defined edge shape is roughly circular.

21. The toy set of claim 1 in which the defined edge shape is roughly polygonal.

22. The toy set of claim 1 in which the defined edge shape is roughly hexagonal.

23. The toy set of claim 1 in which the defined edge shape is roughly pentagonal.

24. The toy set of claim 1 in which the defined edge shape is roughly star-shaped.

25. The toy set of claim 1 in which the defined edge shape may be circumscribed by a circle.

26. The toy set of claim 1 in which the defined edge shape is roughly curved.

27. A toy set that can be assembled into roughly polyhedral shapes, the toy set including a number of toy pieces each made from a relatively thin, flexible foamed plastic material, each having an external edge with a defined edge shape, and each having a center, and including three elongated slots symmetrically arranged around the center of the piece and lying roughly along lines defining the sides of an equilateral triangle to define a roughly triangular polyhedron face, each slot communicating with the edge of the piece, to hold another toy piece inserted on edge in a slot, slot-to-slot, to allow the toy pieces to be interfitted and assembled into polyhedra including roughly triangular faces; in which there is a single tab projecting into each slot, interrupting and changing the course of the slot at the edge of the piece, to firmly hold together the interfitted toy pieces.

28. The toy set of claim 27 in which the toy set also includes toy pieces made from the same material and including more than three slots symmetrically arranged around the center of the piece and lying roughly along lines defining the sides of a regular polygon to define roughly polygonal polyhedron faces, each slot communicating with the edge of the piece, to hold another toy piece inserted in a slot, to allow the toy pieces to be interfitted and assembled into polyhedra including roughly triangular and other roughly regular polygonal faces.

29. A toy set that can be assembled into roughly polyhedral shapes, the toy set including a number of toy pieces each made from a relatively thin, flexible foamed plastic material, each having an external edge With a defined roughly circular edge shape, and each having a center and including three elongated straight slots symmetrically arranged around the center of the piece and lying along lines defining the sides of an equilateral triangle to define a roughly triangular polyhedron face, each slot communicating with the edge of the, to hold another toy piece inserted on edge in a slot, slot-to-slot, to allow the toy pieces to be interfitted and assembled into polyhedra including roughly triangular faces; in which there is a single tab projecting into each slot at the edge of the piece, interrupting and changing the course of the slot, to firmly hold together the interfitted toy pieces.

30. A toy set assembled into a roughly tetrahedral shape, the toy set including four toy pieces each made from a relatively thin, flexible foamed plastic material, each having an external edge with a defined edge shape, and each having a center and including three elongated slots symmetrically arranged around the center of the piece and lying roughly along lines defining the sides of an equilateral triangle to define a roughly triangular tetrahedron face, each slot communicating with the edge of the piece, each slot holding another toy piece inserted on edge therein, slot-to-slot, to hold together the toy pieces into a roughly tetrahedral shape including four roughly triangular faces; in which there is a single tab projecting into each slot at the edge of the piece, interrupting and changing the course of the slot, to firmly hold together the interfitted toy pieces.

31. A toy set assembled into a six-sided roughly polyhedral shape, the toy set including six toy pieces each made from a relatively thin, flexible foamed plastic material, each having an external edge with a defined edge shape, and each having a center and including three elongated slots symmetrically arranged around the center of the piece and lying roughly along lines defining the sides of an equilateral triangle to define a roughly triangular polyhedron face, each slot communicating with the edge of the piece, each slot holding another toy piece inserted on edge therein, slot-to-slot to hold together the toy pieces into a triangular bipyramid polyhedron including six roughly triangular faces; in which there is a single tab projecting into each slot at the edge of the piece, interrupting and changing the course of the slot, to firmly hold together the interfitted toy pieces.

32. A toy set assembled into roughly octahedral shape, the toy set including eight toy pieces each made from a relatively thin, flexible foamed plastic material, each having an external edge with a defined edge shape, and each having a center and including three elongated slots symmetrically arranged around the center of the piece and lying roughly along lines defining the sides of an equilateral triangle to define a roughly triangular octahedron face, each slot communicating with the edge of the piece, each slot holding another toy piece inserted therein, to hold together the toy pieces into a roughly octahedral shape including eight roughly triangular faces; in which there is a single tab projecting into each slot at the edge of the piece, interrupting and changing the course of the slot, to firmly hold together the interfitted toy pieces.

33. A toy set assembled into a roughly platonic solid polyhedral shape, the toy set including a number of toy pieces each made from a relatively thin, flexible foamed plastic material, each having an external edge with a defined edge shape, and each having a center and including three, four or five elongated slots symmetrically arranged around the center of the piece and lying roughly along lines defining the sides of an equilateral triangle, a square and a pentagon, respectively, to define a platonic solid face, each slot communicating with the edge of the piece, to hold another toy piece inserted therein, to hold together the toy pieces into a roughly platonic solid shape including roughly triangular, square or pentagonal faces; in which there is a single tab projecting into each slot at the edge of the piece, interrupting and changing the course of the slot, to firmly hold together the interfitted toy pieces.

* * * * *